US007350581B2

(12) United States Patent
Wynn

(10) Patent No.: US 7,350,581 B2
(45) Date of Patent: Apr. 1, 2008

(54) VAPOR RECOVERY SYSTEM

(75) Inventor: Richard L. Wynn, Fleming, OH (US)

(73) Assignee: Electronic Design for Industry, Inc., Belpre, OH (US)

( * ) Notice: Subject to any disclaimer, the term of this patent is extended or adjusted under 35 U.S.C. 154(b) by 240 days.

(21) Appl. No.: 11/126,901

(22) Filed: May 11, 2005

(65) Prior Publication Data

US 2006/0254777 A1 Nov. 16, 2006

(51) Int. Cl.
*E21B 43/34* (2006.01)
*E21B 43/16* (2006.01)

(52) U.S. Cl. ..... 166/370; 166/75.12

(58) Field of Classification Search ..... 166/75.12, 166/370
See application file for complete search history.

(56) References Cited

U.S. PATENT DOCUMENTS 4,579,565 A * 4/1986 Heath ..... 95/15
6,209,651 B1 * 4/2001 Knight ..... 166/369
2003/0070813 A1 * 4/2003 Irwin, Jr. ..... 166/372
2003/0183394 A1 * 10/2003 Reitz ..... 166/370
2003/0205213 A1 * 11/2003 Aquino et al. ..... 123/241
2006/0144080 A1 * 7/2006 Heath et al. ..... 62/617

* cited by examiner

*Primary Examiner*—David Bagnell
*Assistant Examiner*—Sean D Andrish
(74) *Attorney, Agent, or Firm*—Jason H. Foster; Kremblas, Foster, Phillips & Pollick

(57) ABSTRACT

A vapor recovery apparatus for oil and gas well production that is used in combination with a liquid separator, a sales line and a holding tank includes a compressor, which is drivingly linked to an engine. A first conduit extends from fluid communication with the holding tank to a compressor inlet, while a second conduit extends from a compressor outlet to fluid communication with the sales line. The vapor recovery apparatus also has an electronic controller that is connected to the engine and to a pressure sensor, which is in fluid communication with the gas in the tank.

5 Claims, 12 Drawing Sheets

| |
|---|
| FIG. 3A |
| FIG. 3B |
| FIG. 3C |
| FIG. 3D |
| FIG. 3E |
| FIG. 3F |

| |
|---|
| FIG. 4A |
| FIG. 4B |
| FIG. 4C |
| FIG. 4D |

VAPOR RECOVERY SYSTEM

BACKGROUND OF THE INVENTION

1. Field of the Invention

This invention relates generally to vapor recovery and more specifically, vapor recovery in oil and gas well production equipment.

2. Description of the Related Art

In typical oil and gas well production operations, oil moves from wells through a system of high pressure lines to a holding tank where it is then transferred to a refinery to be used in other applications, for example to power combustion engines. The gas produced in this operation moves through the high-pressure lines, is separated from the oil and then is directed into a sales line where it is distributed to natural gas customers. In separating the oil and gas through this high pressure system, often a small amount of the gas is moved into the holding tank instead of the sales line. Additionally, gas can be produced in the holding tank due to evaporation in the tank. While it is necessary to have some gas in the holding tank to prevent a fire due to the presence of air, too much gas in the holding tank is a problem due to the potential for the tank to rupture.

Currently, when there is too much gas in the holding tank, the gas is released into the atmosphere through a release valve on the top of the tank. For many years the release of this gas into the atmosphere did not appear to be a problem. However, in recent years concerns over air quality and ozone depletion have pressured the industry to make a change to the method of release. The Environmental Protection Agency (EPA) has set mandatory guidelines for the amount of gas that can be released from the holding tank into the atmosphere. Other than burning the gas, there is currently no technology on the market for reducing the amount of gas released from the holding tank into the atmosphere. This is wasteful, because the released gas could be sold to produce useful energy.

Therefore, it is the object and feature of the invention to provide a method and apparatus for reducing the amount of gas being released into the atmosphere from the holding tank during operation of oil and gas well production.

BRIEF SUMMARY OF THE INVENTION

The invention is a vapor recovery apparatus used in oil and gas well production that is used in combination with a liquid separator, a sales line and a holding tank. The vapor recovery apparatus is preferably located between the holding tank and the liquid separator during operation. The vapor recovery apparatus includes a compressor, which is drivingly linked to an engine. A first conduit extends from fluid communication with the holding tank to a compressor inlet, while a second conduit extends from a compressor outlet to fluid communication with the sales line. The vapor recovery apparatus also has an electronic controller that is connected to the engine and to a pressure sensor, which is in fluid communication with the gas in the holding tank.

In operation, the pressure sensor senses when the gas pressure in the holding tank reaches a predetermined level and signals the engine to start. The gas is drawn from the holding tank through a conduit and into the compressor. The gas is compressed by the compressor and forced from the outlet of the compressor through a second conduit and into the sales line. The vapor recovery apparatus thus recovers gas, which is then sold to consumers, that would otherwise be wastefully released into the atmosphere.

Figure 1:
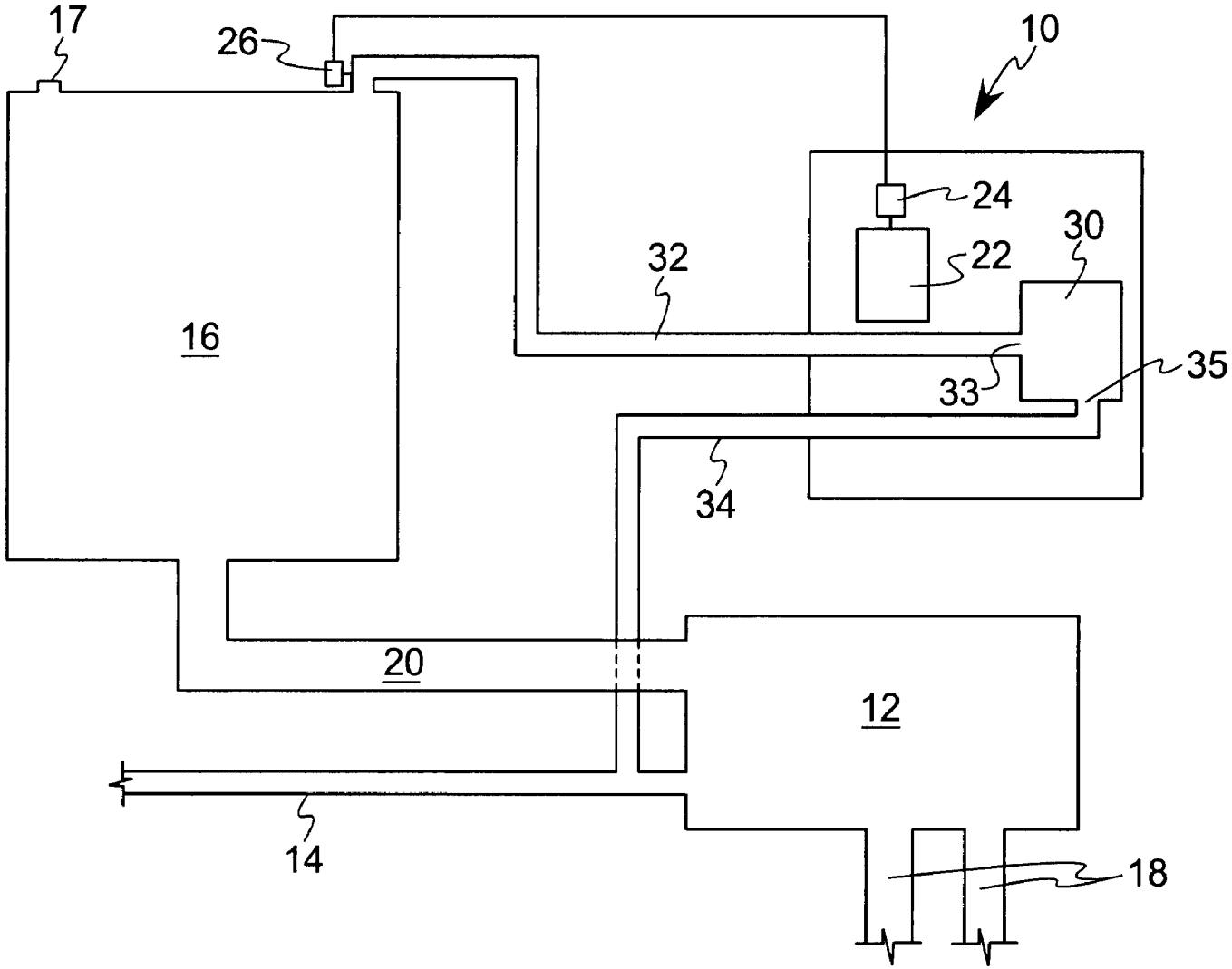
FIG. 1 is a schematic view illustrating the preferred embodiment of the present invention.

In describing the preferred embodiment of the invention, which is illustrated in the drawings, specific terminology will be resorted to for the sake of clarity. However, it is not intended that the invention is limited to the specific term so selected and it is to be understood that each specific term includes all technical equivalents, which operate in a similar manner to accomplish a similar purpose. For example, the word connected or term similar thereto is often used. They are not limited to direct connection, but include connection through other elements where such connection is recognized as being equivalent by those skilled in the art.

DETAILED DESCRIPTION OF THE INVENTION

Figure 2:
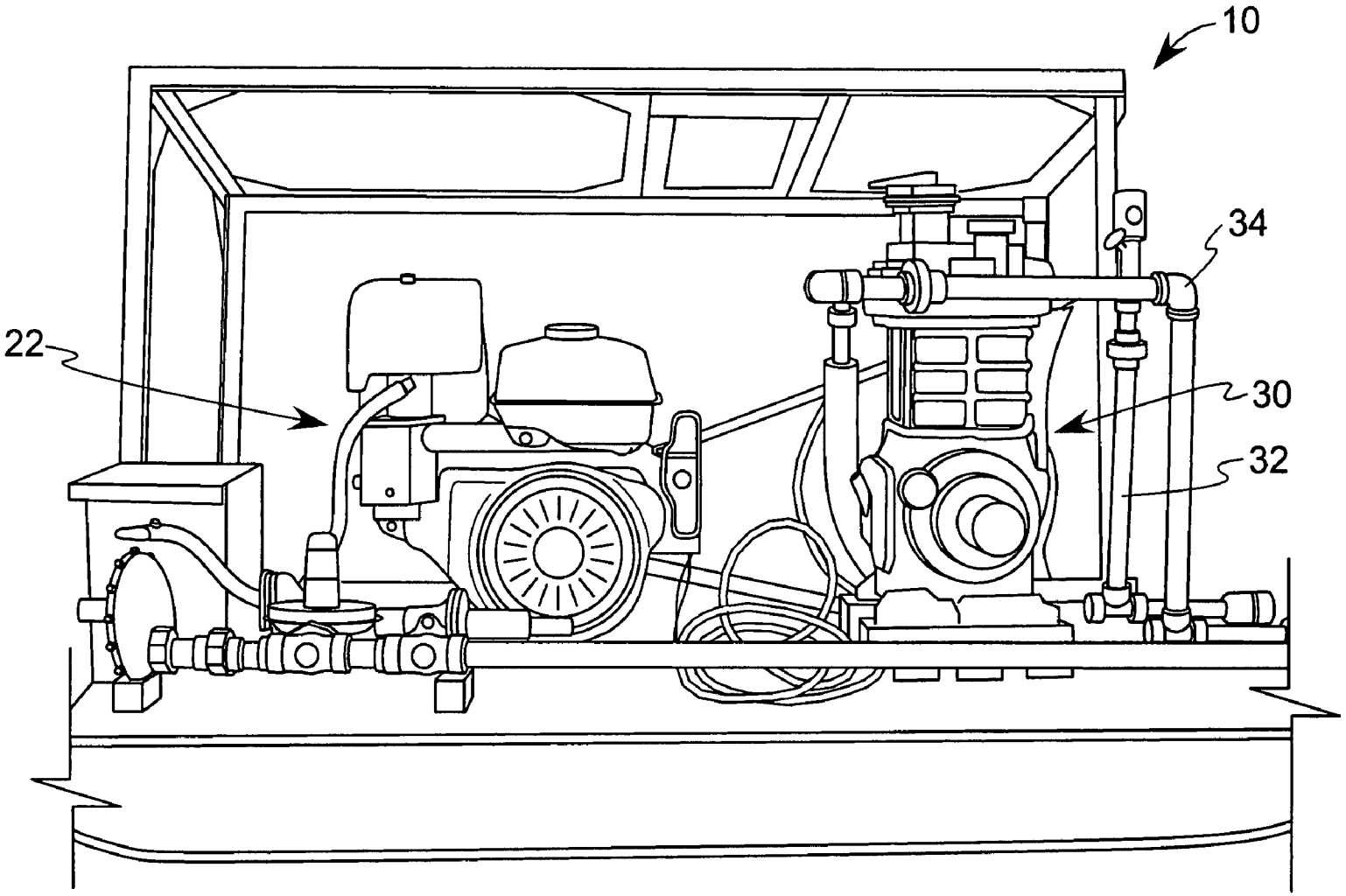
FIG. 2 is a perspective view illustrating the preferred embodiment of the present invention.

The invention is a vapor recovery apparatus 10 that is used in combination with conventional oil and gas well production equipment, as illustrated in FIGS. 1 and 2. In such an operation, the oil and gas is drawn from the wells through tubes 18 and pushed into a liquid separator 12. The liquid separator 12 separates the oil from the gas, moving the gas through a sales line 14, which is a pipe connected to natural gas companies' distribution networks. The oil is pushed by the gas through another pipe 20 into the holding tank 16, where it is stored until the holding tank is full and ready to be distributed for sale. Conventional holding tanks 16 have ENARDO brand valve 17 located on the top of the holding tank 16 for releasing gas pressure that builds up in the tank 16. The valve 17 is a safety release valve to protect the holding tank from retaining too much gas pressure inside and thereby causing the holding tank to fracture.

The vapor recovery apparatus 10, as illustrated in FIG. 1, is preferably interposed between the holding tank 16 and the sales line 14 during operation. This location enables the vapor recovery apparatus to maintain fluid communication with the holding tank 16 and the sales line 14. A person having ordinary skill in the art will recognize that the vapor recovery apparatus 10 can be positioned in a variety of places so long as fluid communication with the holding tank 16 and the sales line 14 is maintained.

As shown in FIGS. 1 and 2, the vapor recovery apparatus 10 includes a compressor 30, which is releasably drivingly linked to an engine 22. The engine 22 is preferably fueled by natural gas. However, any type of prime mover can be used, such as an internal combustion gasoline engine or an electric motor. The compressor 30 can be directly linked to the engine 22 with a drive shaft and a conventional clutch, but the link is preferably a belt and pulley means of releasably linking the engine 22 to the compressor 30. Any other means is possible, as will be recognized by a person having ordinary skill.

A first conduit 32 extends from fluid communication with the holding tank 16 to the compressor inlet 33. The conduit 32 is preferably a circular, cylindrical pipe that extends preferably from the top of the holding tank 16 to the compressor inlet 33. However, the conduit 32 can extend from a variety of locations on the holding tank 16 and have a variety of cylindrical cross-sectional shapes. A second conduit 34 extends from the compressor outlet 35 to fluid communication with the sales line 14. The second conduit 34 is also preferably a circular, cylindrical pipe for transporting gas, but other cross-sectional shapes are available for use with the apparatus. As a person having ordinary skill will recognize, the connection location of the conduit 34 to the sales line 14 may vary depending upon the size and arrangement of the operation. The connection location illustrated in FIG. 1 is only one example of this connection location. In addition, the compressor inlet 33 and outlet 35 can be in a variety of locations on the compressor; the location disclosed is only one example. Still further, the person of ordinary skill will recognize that other structures, such as check valves and other safety equipment, may become necessary.

The vapor recovery apparatus 10 also has an electronic controller 24 that is electronically connected to the engine 22 and to a pressure sensor 26, which is in fluid communication with the gas in the holding tank 16. The pressure sensor 26 monitors the pressure of gas in the holding tank 16, preferably by monitoring the pressure in the first conduit 32, and sends a signal to the controller 24 that correlates to the pressure. Thus, the sensor 26 signals the controller 24 when the gas in the holding tank 16 reaches a predetermined pressure. The electronic controller 24 can be connected to the engine 22 in a variety of ways including an electronic connection to the engine's computer.

The operation of the vaper recovery apparatus 10 during oil and gas well production begins when oil flows from the wells through the tubes 18 into the separator 12. The separator works in a conventional manner to separate the oil from the gas. The oil is pushed in a conventional manner by a minimal amount of gas from the separator 12 through a pipe 20 into the holding tank 16, where it is held until the holding tank 16 is full. The holding tank 16, while being mostly filled with oil also contains some of the gas that pushed the oil into the tank. Due to the well-known differences in properties of the oil and gas, the gas rises to the top of the holding tank 16 while the oil settles below.

A thin layer of gas is necessary to remain over the oil in order to prevent a volatile atmosphere when the holding tank 16 is opened and oxygen enters the tank 16. Additionally, because gas can reach high pressures that can fracture a tank, this pressure must be released.

The pressure sensor 26 monitors the pressure of the gas in the holding tank 16. When the pressure sensor 26 senses that the pressure in the holding tank 16 is at a first predetermined level, the pressure sensor 26 sends a signal to the electronic controller 24. The signal can be continuous, or could be limited to when the pressure reaches certain limits. The electronic controller 24 then starts the engine 22 to actuate an electric starting motor. The engine 22 preferably begins to warm up not driving the compressor, for at least one minute. After the one-minute warm up time has elapsed, the clutch, which is connected to the engine in a conventional manner, is engaged to drive the compressor. At this point the engine 22 and the free spinning compressor 30 (the internal parts of the compressor are being moved by the engine but do not pump gas from the holding tank), can run for any length of time. The compressor can be actuated by the controller to change from the free-spinning condition to a pumping or loaded condition in a conventional manner. The engine 22 runs this way until the pressure sensor 26 senses that there is a second predetermined level of gas pressure in the holding tank 16.

When the pressure sensor 26 senses the second predetermined level of gas pressure in the tank 16, the controller actuates, i.e. loads, the compressor 30 to begin to pump gas from the holding tank 16. The gas is drawn from the holding tank 16 through the first conduit 32 and into the compressor via the inlet 33, where the compressor 30 compresses the gas. The compressor 30 then forces the pressurized gas from the outlet 35 of the compressor 30 through the second conduit 34 and into the sales line 14. Once in the sales line 14, the gas is sold to a natural gas company for resale to consumers in the conventional manner.

When the pressure sensor 26 on the holding tank 16 senses that there is less than the first predetermined level of gas pressure remaining in the tank 16, the pressure sensor signals the electronic controller 24 to unload the compressor 30, thereby keeping the compressor 30 from pumping gas from the holding tank. A timer, which is a part of the electronic controller 24, can be set for a predetermined amount of time. Once the predetermined amount of time has elapsed, if the gas pressure in the holding tank 16 does not reach the second predetermined level, the electronic controller turns the engine off. However, if the gas pressure in the holding tank 16 reaches the second predetermined level during the predetermined amount of time, then the compressor is actuated again to pump gas in the holding tank into the sales line 14 and the timer is reset, as described above. This method can work to operate the vapor recovery apparatus 10 any number of times throughout the course of filling the holding tank 16 with oil or simply storing oil in the holding tank.

Figures 3, 3A:
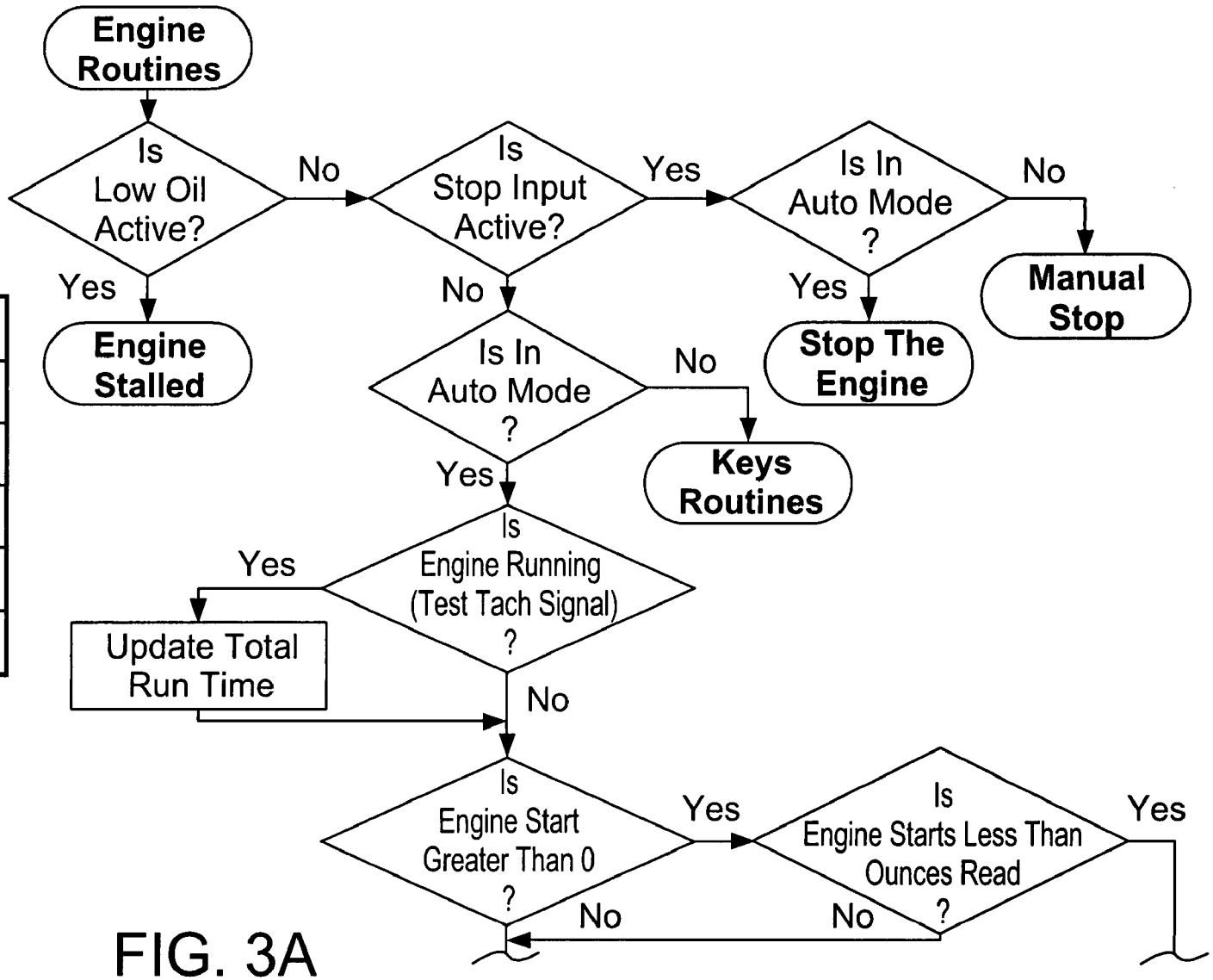
FIG. 3 is a flow chart illustrating the preferred steps of the embodiment of FIG. 1.
Figure 3B:
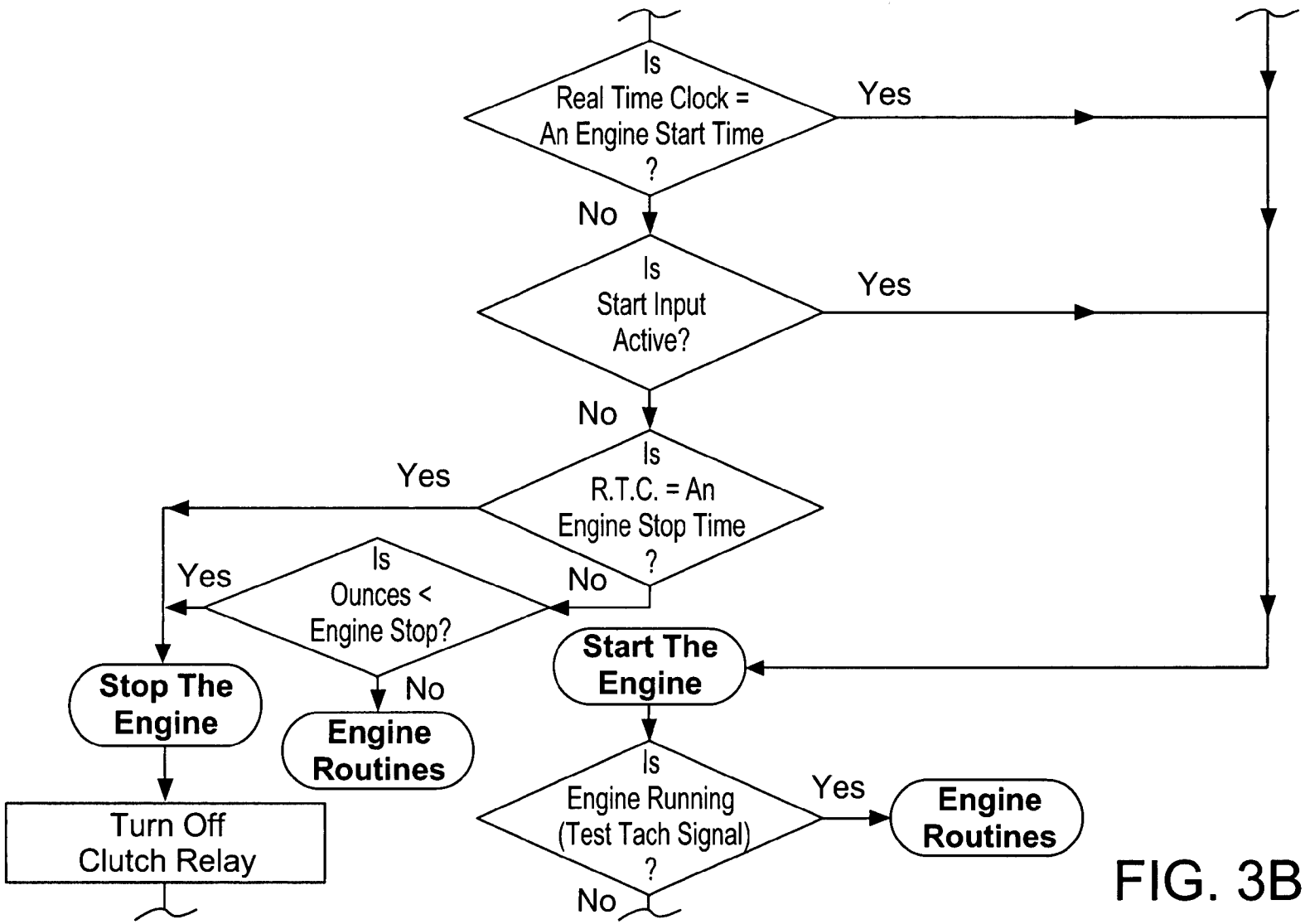
Figure 3C:
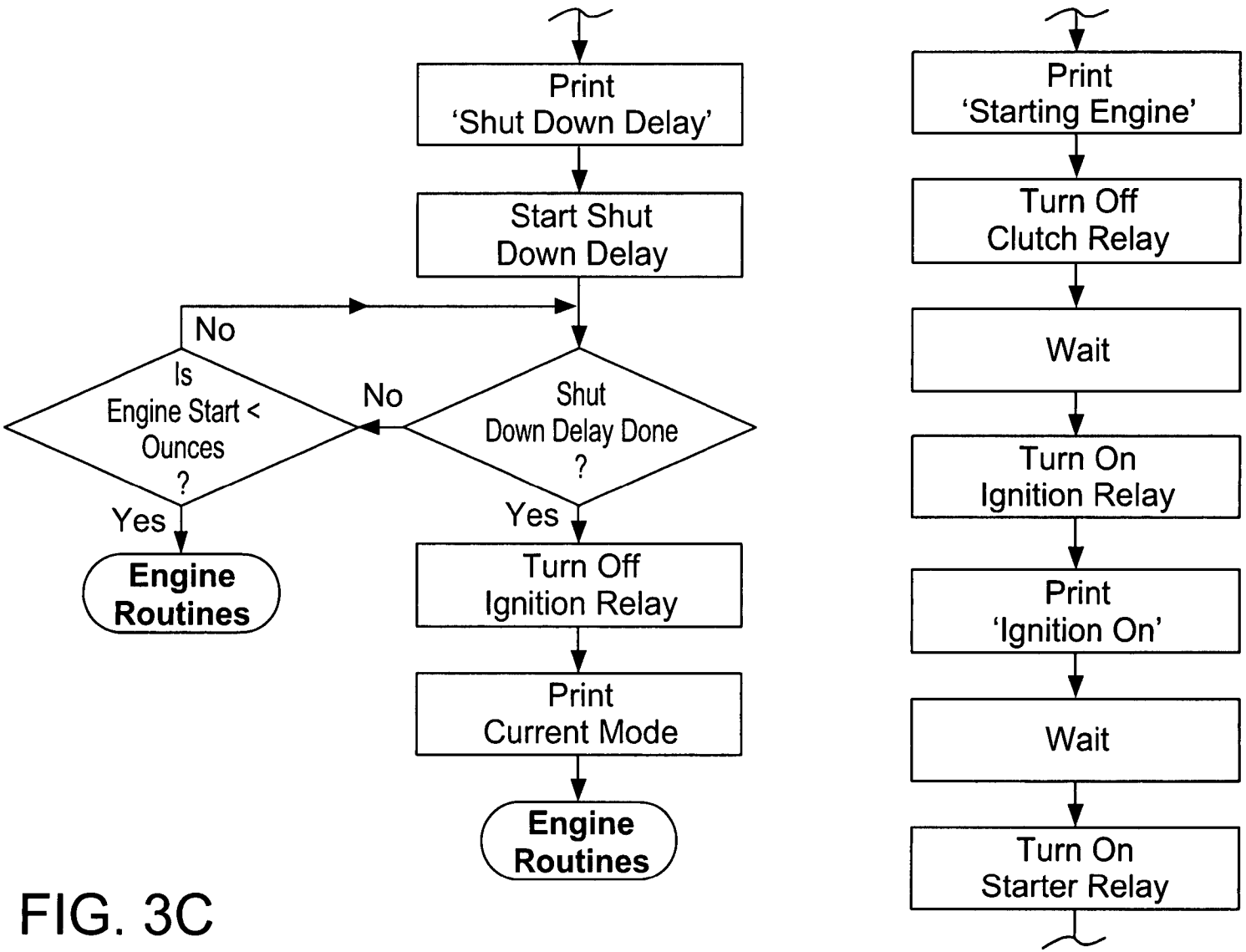
Figure 3D:
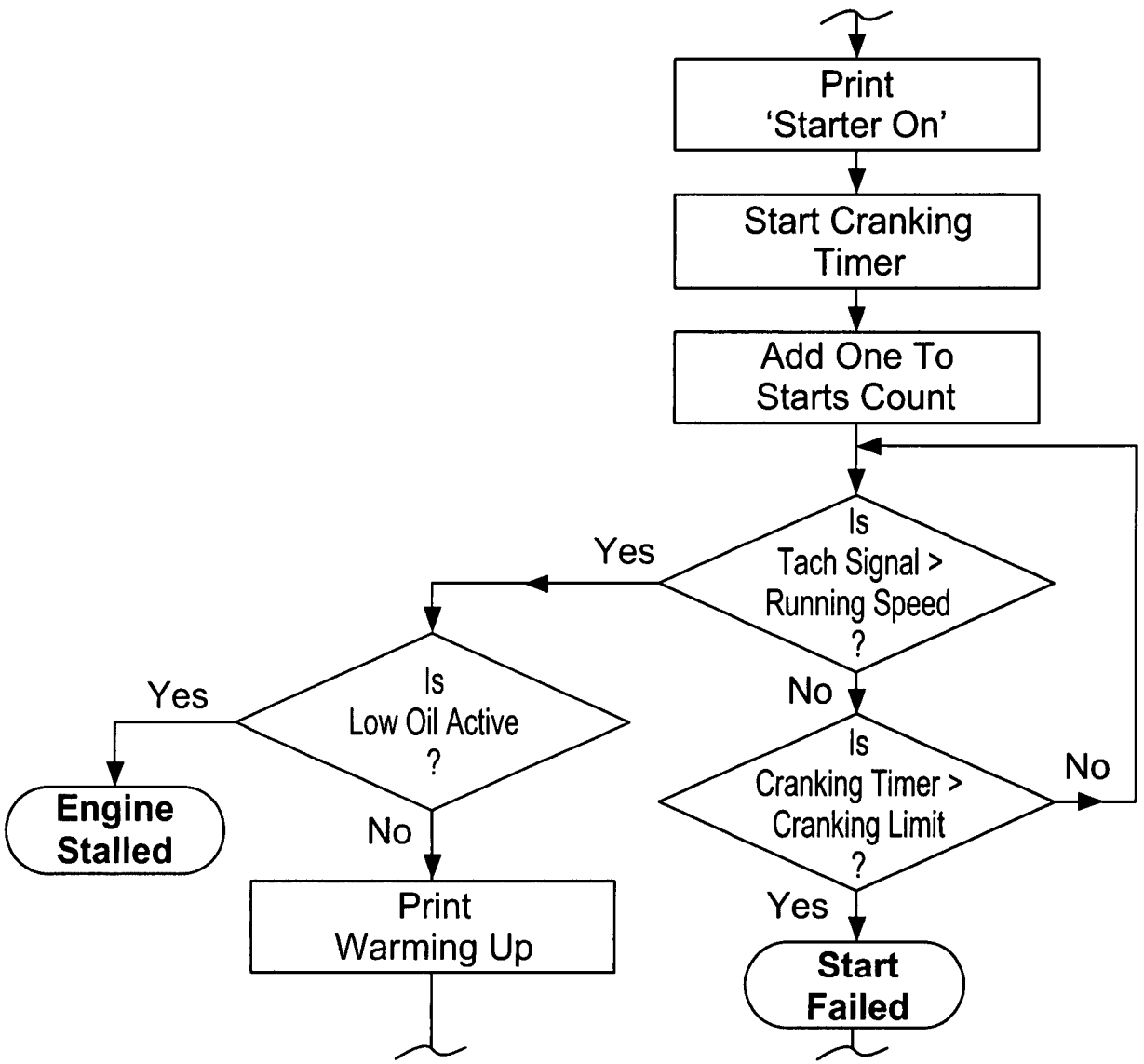
Figure 3E:
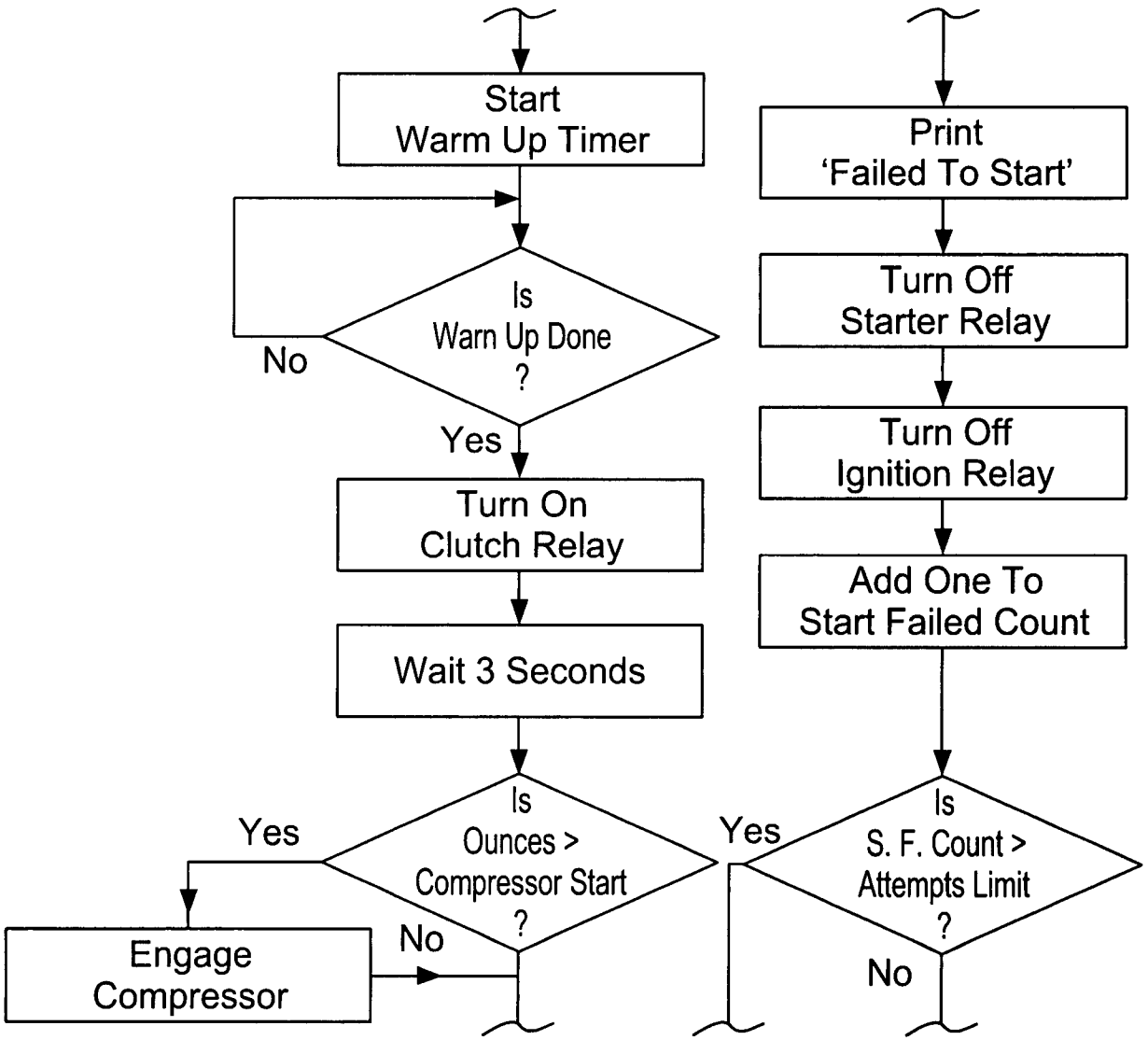
Figure 3F:
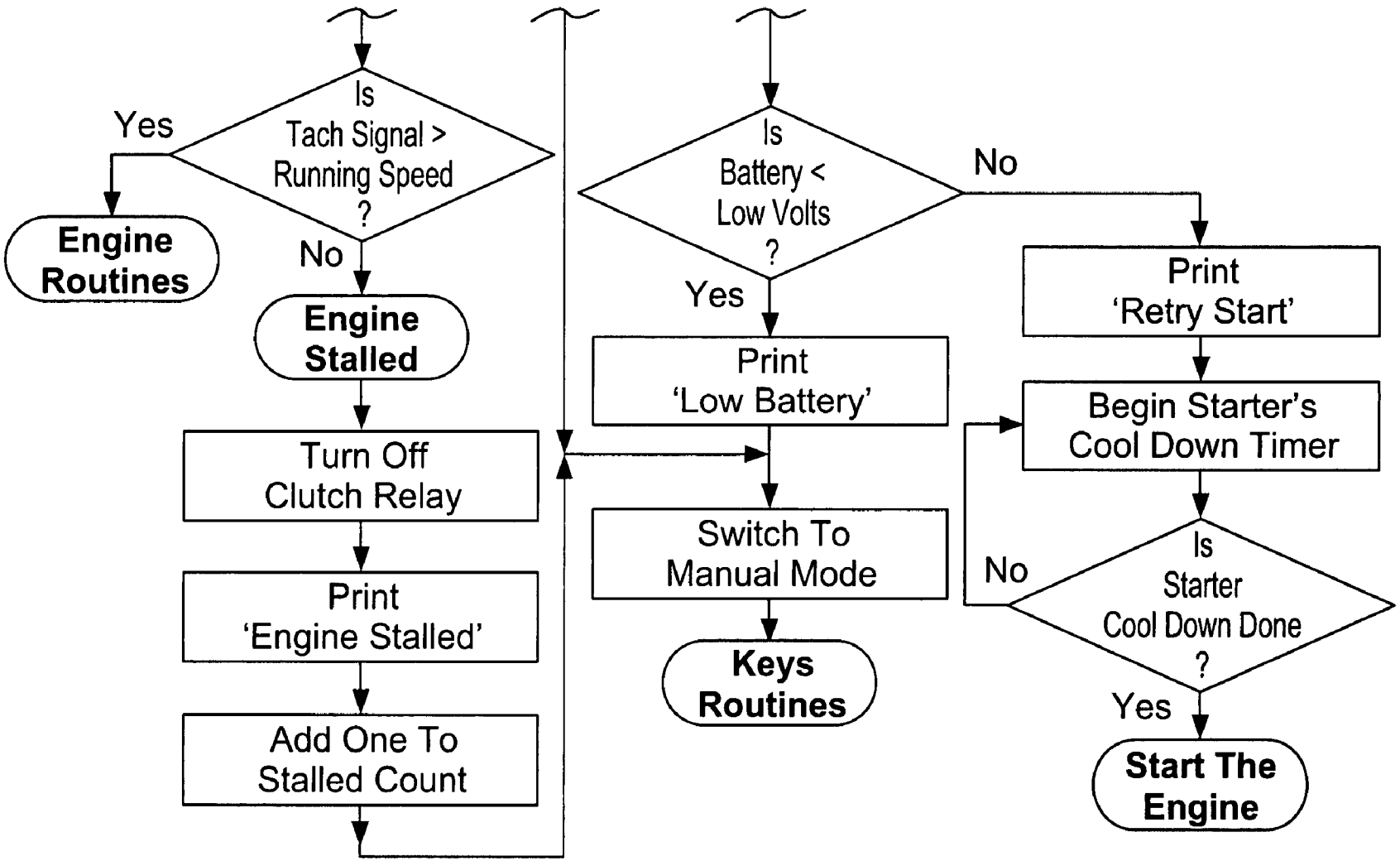
Figures 4, 4A:
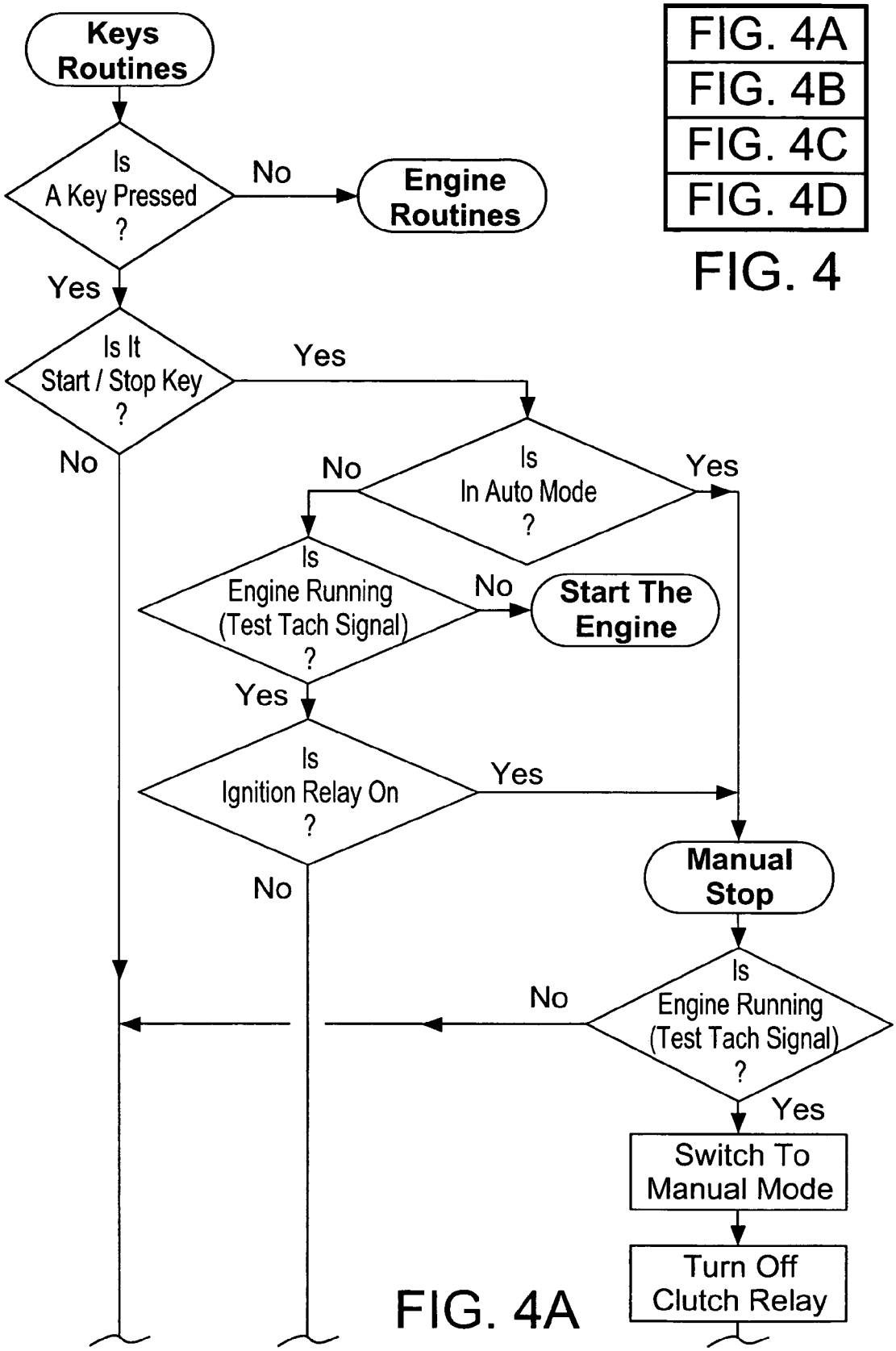
FIG. 4 is a flow chart illustrating the steps of the invention.
Figure 4B:
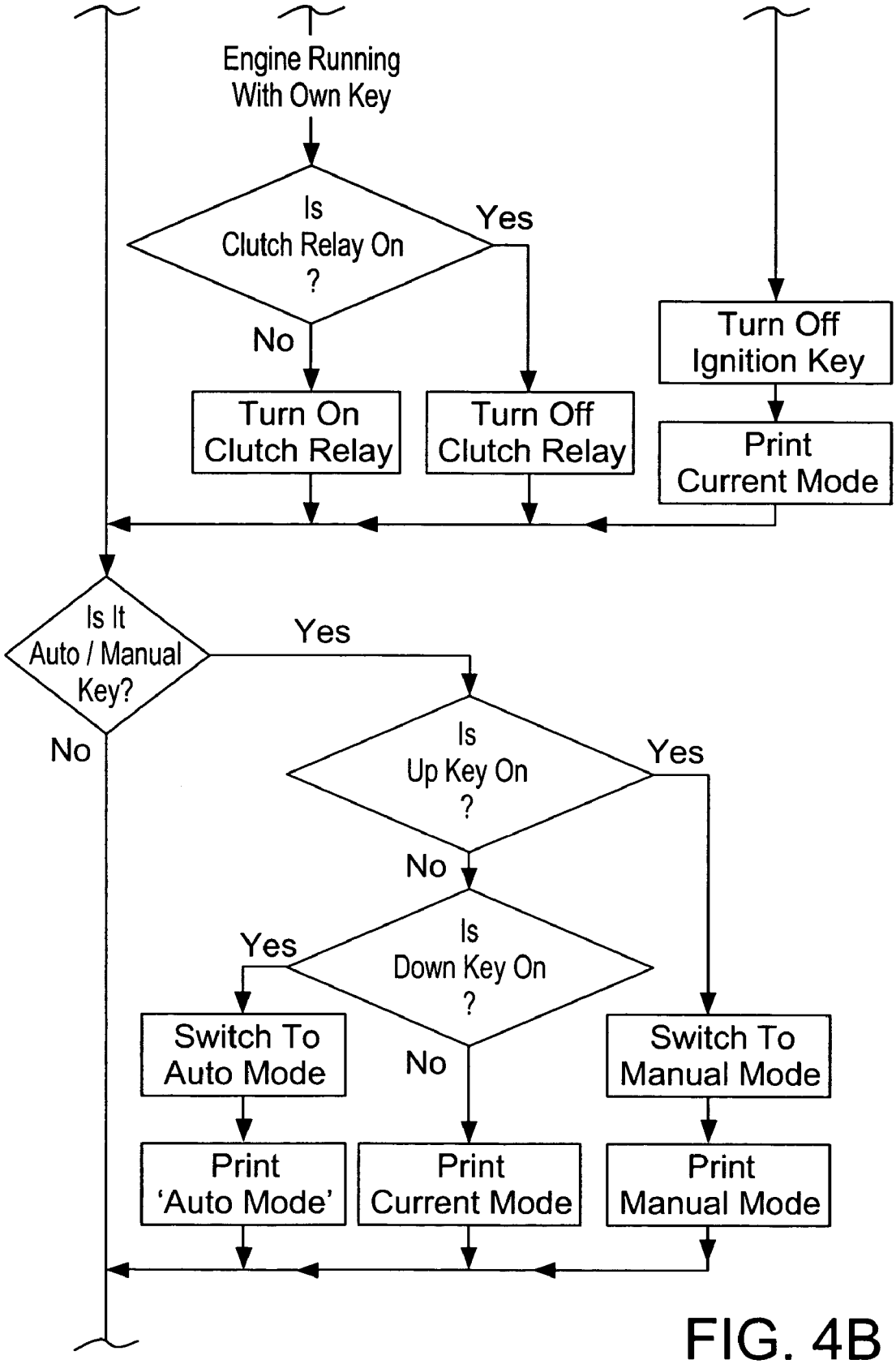
Figure 4C:
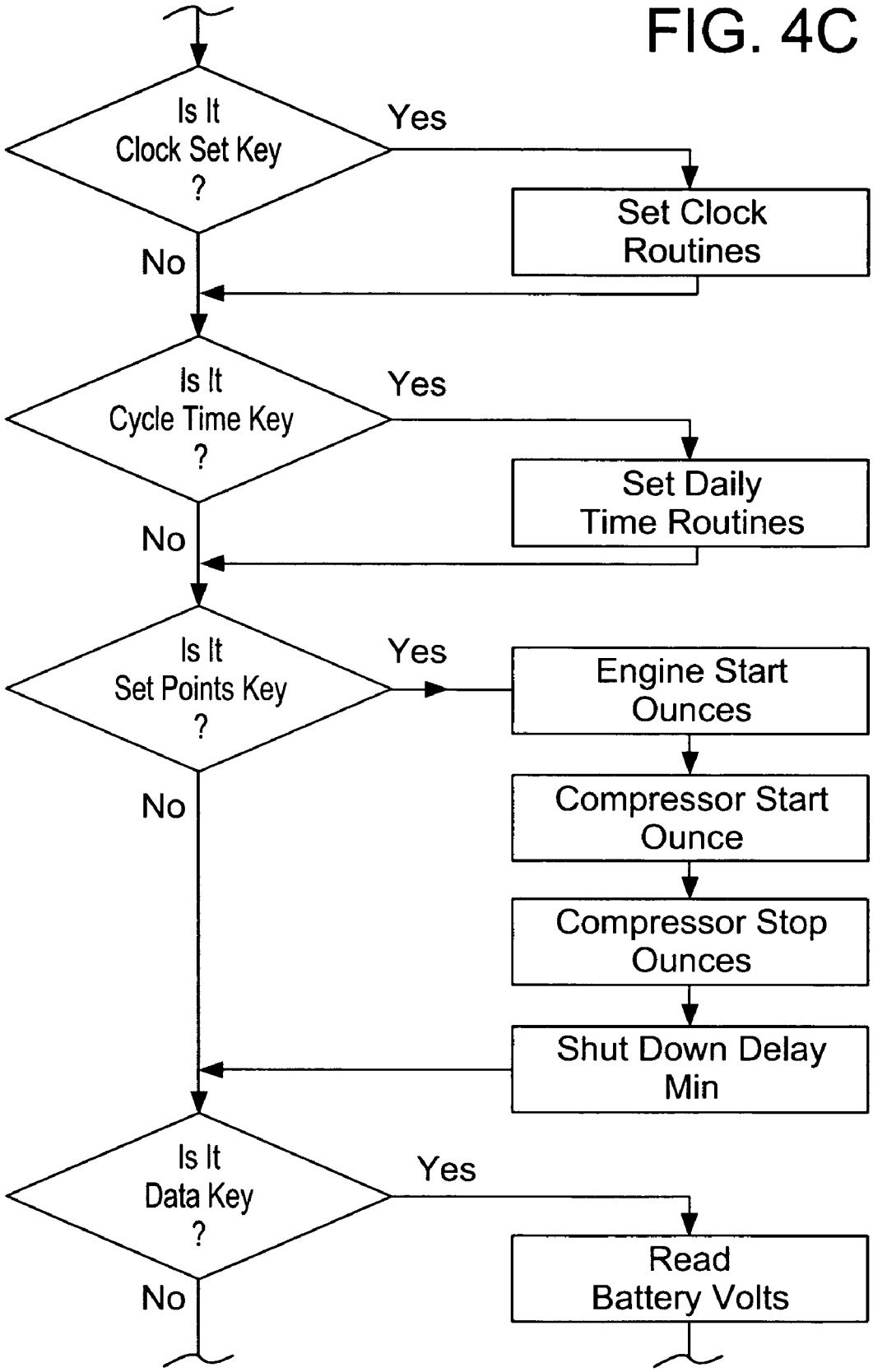
Figure 4D:
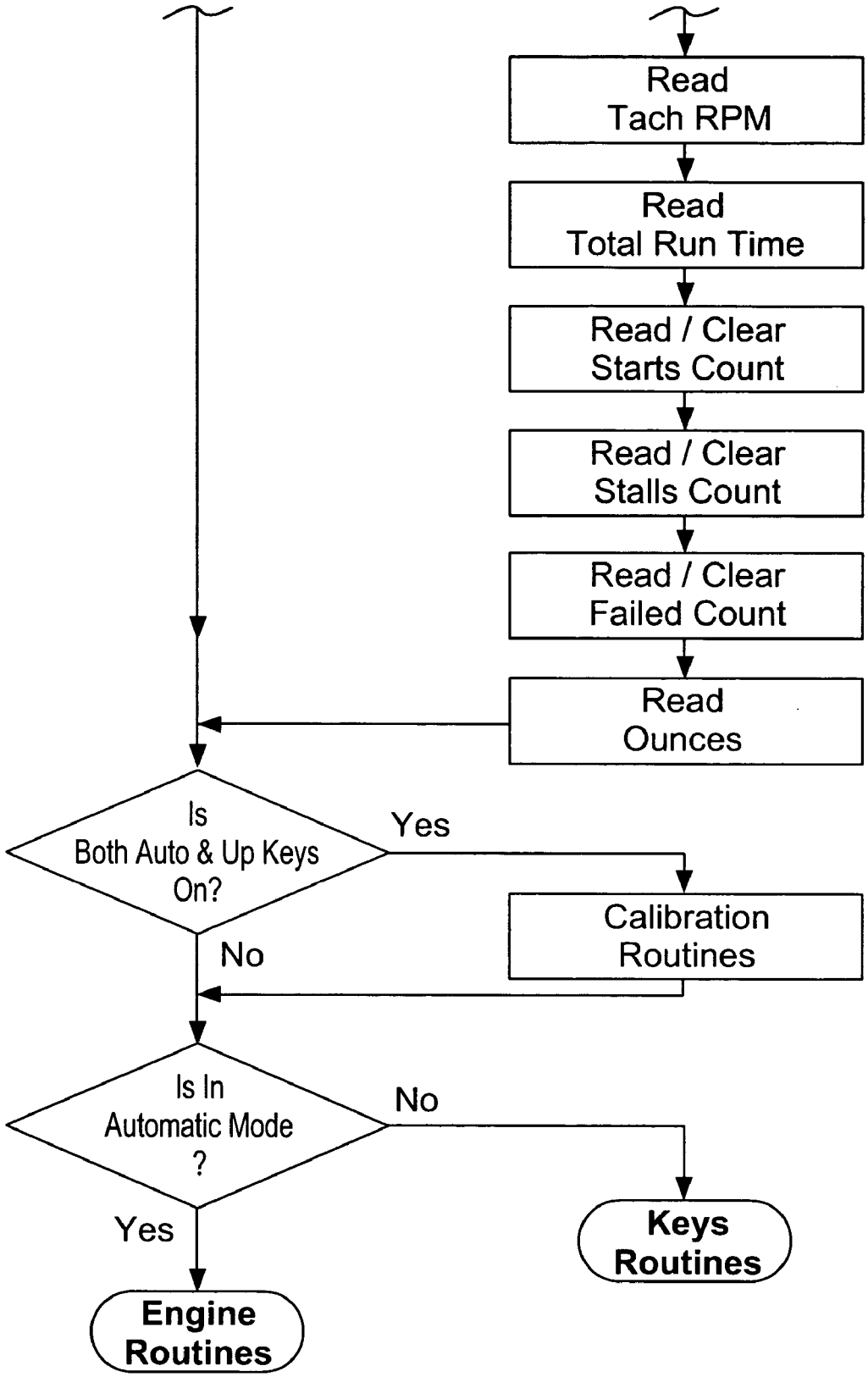

An example of the operation of the vapor recovery apparatus is given below, and a flow chart illustrating a series of steps that can be taken is illustrated in FIG. 3. As will be recognized by a person having ordinary skill, the examples given are only representations of numerical values given for gas pressures; a range of gas pressures and times can be used with the apparatus.

When the pressure sensor 26 of the vapor recovery apparatus 10 senses that the gas pressure in the holding tank 16 is at least 2 ounces per square inch, which is the first predetermined level, the sensor 26 signals the electronic controller 24 to start the engine. The engine 22 begins to warm up and runs for at least one minute and then engages the clutch to begin engaging the compressor without compressing gas of the holding tank 16.

When the pressure sensor 26 senses a gas pressure of at least 12 ounces per square inch in the holding tank 16, which is the second predetermined level, the compressor 30 is loaded. Gas is drawn from the holding tank 16 through the first conduit 32 and into the compressor via the inlet 33 where the compressor 30 compresses the gas. The compressor 30 then forces the gas from the outlet 35 of the compressor 30 through the second conduit 34 and into the sales line 14. When the pressure sensor 26 on the holding tank 16 senses that there is less than 2 ounces per square inch of gas pressure remaining in the tank 16, the pressure sensor signals the electronic controller 24 to unload the compressor 30 (stop compressing). At this point, the timer that is within the controller is set for approximately 15 minutes and begins to run. If the gas pressure in the holding tank 16 does not reach 12 ounces per square inch during the 15 minutes, the electronic controller turns the engine, and therefore the compressor, off. However, if the gas pressure in the holding tank 16 reaches 12 ounces per square inch during the 15 minutes, then the compressor will be loaded and the gas will be compressed as described above. Once the compressor is loaded, the timer is reset to approximately 15 minutes. This operation runs in a cycle as many times as necessary.

There are many advantages to using the vapor recovery apparatus 10 in oil and gas well production operations. One advantage is that the vapor recovery apparatus 10 is easily movable between oil and gas well production operations because it is mounted to a platform. Furthermore, the gas, which would have been wastefully released into the atmosphere, is recovered and then sold to consumers. The owners and operators of oil and gas well production operations will see an increase in sales and will be in compliance with Environmental Protection Agency regulations.

While certain preferred embodiments of the present invention have been disclosed in detail, it is to be understood that various modifications may be adopted without departing from the spirit of the invention or scope of the following claims.

The invention claimed is:

1. A method for recovering vapors from oil and gas well equipment in fluid communication with a well, the equipment including a natural gas sales line, a holding tank that stores liquid removed from the well, and a liquid separator interposed between the well and the holding tank, the method comprising:

(a) interposing a compressor, which is drivingly linked to an engine, between the holding tank and the sales line;

(b) extending a first conduit in fluid communication with the holding tank to a compressor inlet;

(c) extending a second conduit from a compressor outlet to fluid communication with the sales line;

(d) connecting a controller to the engine;

(e) connecting a pressure sensor in fluid communication with the controller and an interior chamber of the holding tank for measuring the pressure within the interior chamber;

(f) monitoring the pressure of a gas in the interior chamber of the holding tank;

(g) signaling the controller when the gas in the holding tank reaches a predetermined pressure;

(h) starting the engine when the predetermined pressure is reached;

(i) drawing the gas from the holding tank through said first conduit and the compressor inlet, and compressing the gas in the compressor; and (j) forcing the compressed gas from the outlet of the compressor through the second conduit into the sales line.

2. The method in accordance with claim 1, further comprising the step of shutting the engine off when the pressure of gas in the interior chamber of the holding tank falls below at least about the predetermined pressure for a predetermined amount of time.

3. The method in accordance with claim 2, further comprising running the engine unloaded for at least one minute.

4. The method in accordance with claim 3, wherein said predetermined pressure in the holding tank is at least 2 ounces per square inch of pressure.

5. The method in accordance with claim 4, wherein the controller is configured to link the engine with the compressor when there is at least 12 ounces per square inch of pressure in the holding tank.

* * * * *